United States Patent [19]

Bergman

[11] 4,140,074

[45] Feb. 20, 1979

[54] SYSTEM FOR STABILIZING A FLOATING VESSEL

[75] Inventor: Gunnar B. Bergman, Montecito, Calif.

[73] Assignee: Seatek, Santa Barbara, Calif.

[21] Appl. No.: 787,756

[22] Filed: Apr. 15, 1977

[51] Int. Cl.[2] ..... B63B 39/00

[52] U.S. Cl. ..... 114/125

[58] Field of Search ..... 114/121, 122, 125

[56] References Cited

U.S. PATENT DOCUMENTS

| | | | |
|---|---|---|---|
| 968,927 | 8/1910 | Frahm | 114/125 |
| 1,700,406 | 1/1929 | Hammond, Jr. | 114/125 |
| 3,537,412 | 11/1970 | Henderson | 114/125 X |
| 3,689,953 | 9/1972 | Markakis | 114/125 X |

FOREIGN PATENT DOCUMENTS

| | | | |
|---|---|---|---|
| 1020451 | 2/1966 | United Kingdom | 114/125 |

*Primary Examiner*—Trygve M. Blix
*Assistant Examiner*—Sherman D. Basinger
*Attorney, Agent, or Firm*—Stephen P. Fox

[57] ABSTRACT

A seagoing vessel is stabilized by a passive system including tanks symmetrically disposed on the vessel below the water line. The tanks are connected by a conduit and pressurized with air to a selected pressure level. During each oscillatory roll and/or pitch cycle of the vessel, the tanks alternately fill and drain with selected volumes of water, thereby to reduce the righting moment of the vessel. The period of oscillation of the vessel is lengthened beyond the period of wave motion.

5 Claims, 6 Drawing Figures

SYSTEM FOR STABILIZING A FLOATING VESSEL

BACKGROUND OF THE INVENTION

Seagoing vessels are required in various types of offshore operations, including scientific surveys and oil and gas drilling and production. Such vessels are typically configured as drillships, barges and jack-up rigs, as well as supply and service ships.

Both active and passive techniques have been proposed for damping the natural oscillatory displacement of vessels to achieve roll and pitch stabilization in seas having periodic wave motion. Such techniques have utilized water tanks on the vessels and various arrangements of blowers, pumps, valves, valve actuators, roll and pitch sensors, and electronic control circuits for moving water in the tanks to counteract oscillatory roll and pitch motion. A common objective of heretofore known systems has been to make the natural frequency of oscillatory flow of water in the tanks the same as the natural frequency of oscillations of the vessel, thereby to "tune" the tanks to the vessel. Once tuned, the damping action is achieved by causing the flow pattern of water in the tanks to be approximately 90° out of phase with the natural oscillations of the vessel. The forces produced by the water in the tanks then tend to counteract the roll and pitch forces on the vessel.

Prior systems that attempt to achieve stabilization in the manner described above have the disadvantage that large counteracting, damping forces must be produced in order for the system to be effective. The equipment required to provide the large counteracting forces is complex and expensive. In active systems, high power blowers and pumps are typically required. Passive systems generally require high-capacity valves, special stabilizing tank configurations and control circuits for timing the flow of water in the tanks.

SUMMARY OF THE INVENTION

The present invention provides stabilization of a seagoing vessel with a passive system which does not rely on the use of tanks having a natural period which is substantially the same as the natural oscillatory period of the vessel to produce large counteracting forces that damp the angular motion of the vessel. Instead, tanks are used for the purpose of reducing the righting moment of the vessel as described below.

In accordance with an illustrated embodiment of the invention, water tanks are disposed on opposite sides of the longitudinal axis of symmetry of the vessel. The tanks are located below the water line, preferably on the bottom of the vessel. The tanks have a shallow configuration, with larger horizontal dimensions than vertical dimensions, and the bottom portion of each tank is substantially completely open to the sea, thereby to permit sea water to rapidly fill and drain from the tanks in a short time period which is much less than the period of natural oscillatory motion of the vessel. An open conduit interconnects the tanks to provide a continuous air passageway between them. An air pump is coupled to the conduit to pressurize the tanks to a preselected pressure level, thereby to permit selected water levels to be attained in the tanks during oscillatory wave motion.

In operation, the water tanks alternately fill and drain in synchronism with oscillatory wave motion. For example, as the vessel tends to roll clockwise on its central longitudinal axis, the tank on the right side of the vessel will quickly fill through its large bottom opening. Air is forced out of this tank through the conduit and into the tank on the left side of the vessel. The increased air volume in the left tank rapidly forces water out of it. As the vessel tends to roll counterclockwise, the left tank fills and the right tank is forced to drain under the force of the air pressure in the system.

A feature of the system of the present invention is that it acts to reduce the righting moment of the vessel in a periodic sea. For example, as the vessel tends to roll in one direction, the system reduces the tendency of the vessel to restore itself to an upright position. The reduction of the righting moment lengthens the period of oscillation of the vessel beyond the wave period of the sea. This in turn substantially reduces the amplitude of the roll.

DESCRIPTION OF THE PREFERRED EMBODIMENTS

Figure 1:
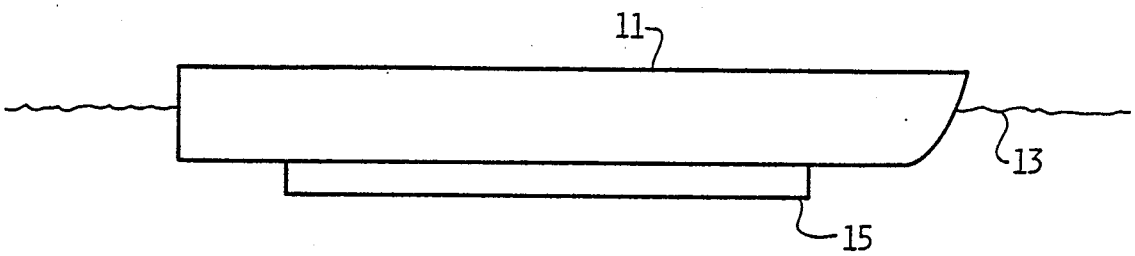
FIG. 1 is a side view of a vessel illustrating one embodiment of the stabilizing tanks of the system constructed according to the principles of the present invention.
Figure 2:
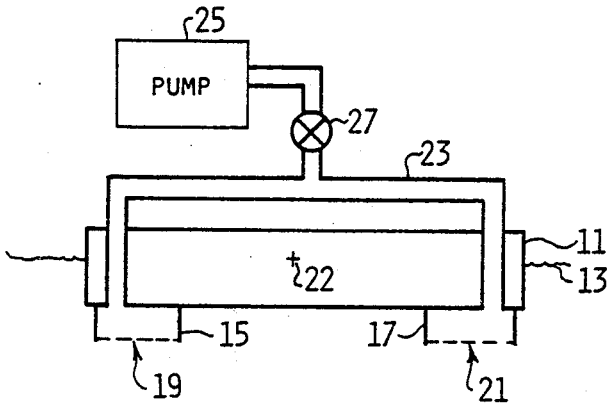
FIG. 2 is a diagrammatic end view of the vessel of FIG. 1 illustrating an embodiment of the stabilizing system constructed according to the principles of the present invention.
Figure 3:
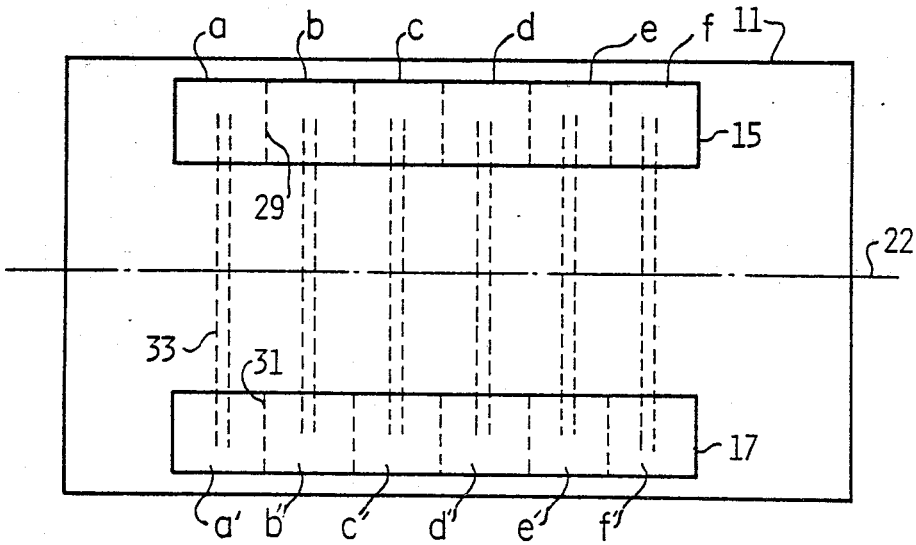
FIG. 3 is a bottom view of the vessel of FIG. 1 illustrating the location and coupling of the stabilizing tanks.

Referring now to FIGS. 1–3, there is shown a vessel 11 in the form of a barge of the type used in offshore oil drilling operations. Disposed below the water line 13, on the bottom of barge 11 are two elongated tanks 15, 17. Tanks 15, 17 respectively have bottom portions generally designated at 19, 21 (FIG. 2). Bottom portions 19, 21 are preferably substantially completely open to the sea; however, alternatively the bottom portions may be covered by a perforated plate or grating to provide greater structural strength. The tanks 15, 17 each have a shallow configuration, with larger horizontal dimensions than vertical dimensions. With this arrangement sea water may fill and drain from the tanks very rapidly. More particularly, the tanks must be configured so as to permit filling and draining during a short time period which is much less than the time required for the barge to complete one cycle of natural oscillatory roll or pitch motion in a periodic sea.

As shown, barge 11 has a longitudinal axis of symmetry 22. Tanks 15, 17 are disposed symmetrically in spaced-apart relation on opposite sides of axis 22.

Tanks 15, 17 are coupled together by a conduit 23 shown diagrammatically in FIG. 2. Conduit 23 is in the form of a continuous, open pipe providing an air passageway between the tanks. One end of conduit 23 is connected through a port to the top surface of tank 15, while the other end of conduit 23 is connected through a port to the top surface of tank 17.

Means including an air pump or blower 25 and air valve 27 are coupled to conduit 23 to provide air pressure in the conduit and tanks 15, 17. Conduit 23 and tanks 15, 17 form a closed system and the air pressure therein may be selected by opening valve 27 and operating pump 25 until a desired air pressure is reached. Thereafter, valve 27 is closed. Alternatively, valve 27 may be eliminated or left open and air pump 25 continuously operated at a selected rate to maintain the desired air pressure in the system. Preferably the air pressure is adjusted until sea water is permitted to fill the tanks alternately during oscillatory wave motion, as hereinafter described.

With reference to FIG. 3, each of the tanks 15, 17 may be divided into a plurality of separate compartments. Tank 15 comprises six compartments a, b, c, d, e, and f, each isolated from the other by intermediate walls represented by dashed lines 29. Similarly tank 17 comprises separate compartments a', b', c', d', e', and f' isolated by walls 31. The compartments are disposed in spaced-apart symmetrical pairs on opposite sides of longitudinal axis 22, the pairs comprising compartments a and a', b and b', etc. Compartmentalization of tanks 15, 17 serves to minimize excitation of waves and undesirable consequent wave forces on the free water surface of water contained inside the tanks.

Each pair of compartments is coupled by separate conduit means, generally indicated by dashed outline pipes 33. Thus, the pair of compartments a, a' is coupled in a closed pressurized system as shown in FIG. 2. The other pairs of compartments are similarly separately coupled. A common blower and ducting arrangement (not shown) may be used to supply air pressure to all pairs of compartments.

Figure 4:
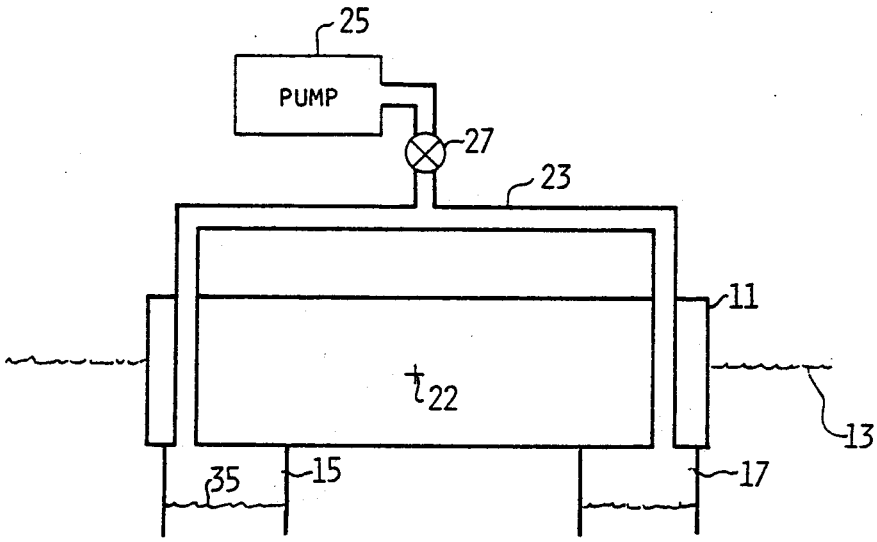
FIGS. 4 and 5 are diagrammatic end views of the vessel of FIG. 1 illustrating the operation of one embodiment of the system of the present invention.
Figure 5:
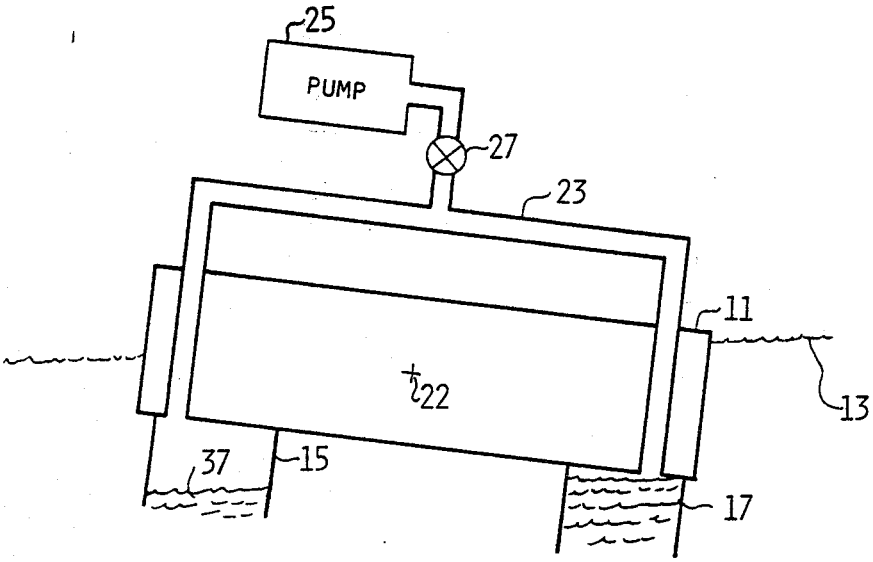

Operation of the system of FIGS. 1–3 may be understood by reference to FIGS. 4 and 5. As shown in FIG. 4, the tanks 15, 17 of vessel 11 are initially pressurized by air pump 25 so that sea water fills about one-half of each tank in a quiet sea, as indicated by the water surfaces 35. As vessel 11 tends to roll about axis 22 in a clockwise direction, as shown in FIG. 5, tank 17 will fill with water, thus driving air out of tank 17 through conduit 23 and into tank 15. The increasing volume of air in tank 15 forces water to drain from the tank and lowers the level of water surface 37. During this operation, either valve 27 is closed, or valve 27 is open and pump 25 is running to maintain constant air pressure in the tanks and conduit. Thus, the volume of air displaced from tank 17 is transferred to tank 15. When roll displacement is counterclockwise, tank 15 is filled and tank 17 is drained in the same manner as described above.

The filling of tank 17 with water as the vessel 11 tends to roll clockwise has the effect of reducing the righting moment of the vessel. In other words, the tendency of the vessel to return to an upright condition after a roll is commenced will be reduced, thus making the oscillatory roll motion of the vessel more sluggish. The roll period of the vessel is lengthened. In a typical sea where the wave motion has a seven second period, the roll period of the vessel produced by the system of the present invention is preferably lengthened to about twelve seconds. Since the roll period of the vessel is substantially longer than the period of wave motion, the waves have a greatly diminished effect on the vessel.

It is to be understood that the reduction in righting moment of the vessel in a quiet sea by the system of the present invention will also reduce roll torque in a sea having periodic wave motion. Tanks 15, 17 are dimensioned such that when air has been pumped into them, there is still a positive metacentric height, i.e., a positive righting moment. During operation in a periodic sea, there may be a tendency for the vessel 11 to overturn if the righting moment is reduced too much. This is especially true if the vessel is subjected to strong winds. A significant safety feature of the system of the present invention is that tank height dimension and initial quiescent water level within the tank (e.g., tank 17) are selected so that during very large roll of the vessel the tank fills completely. Once a tank is filled, the normal buoyancy forces on the vessel are restored and the righting moment increases rapidly as a function of additional angular roll displacement, thereby to prevent capsizing of the vessel.

Figure 6:
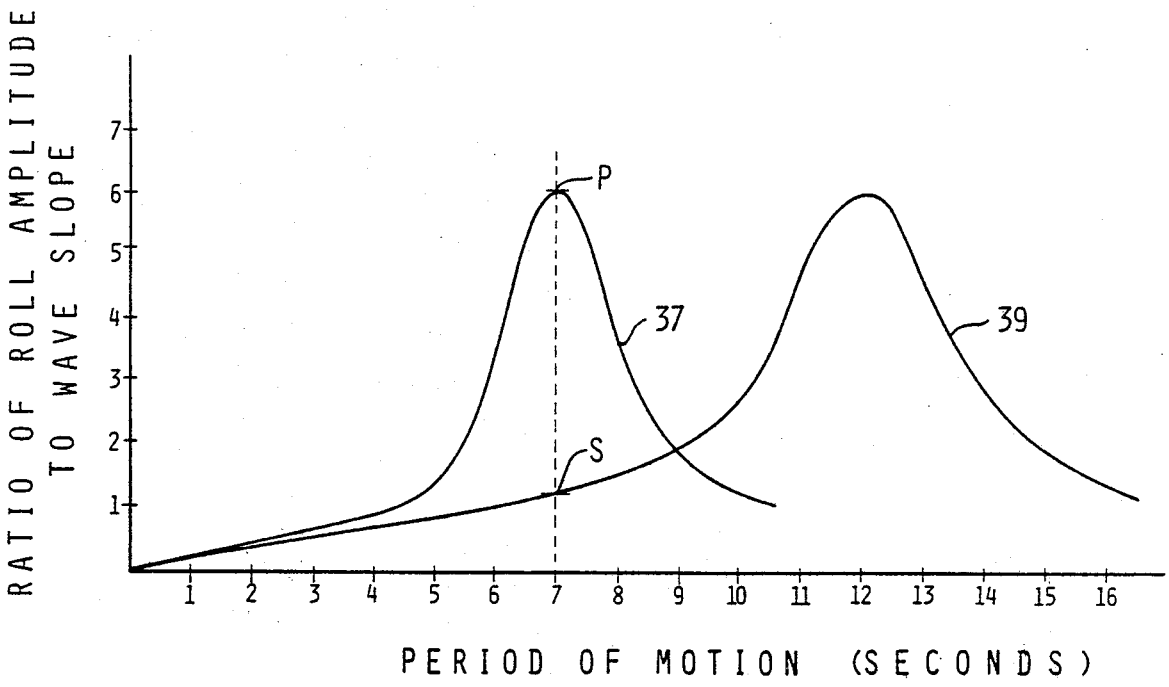
FIG. 6 is a graph illustrating the magnitude of the ratio of roll amplitude to wave slope as a function of the period of wave motion for vessels with and without the system of the present invention.

FIG. 6 illustrates by comparison the effect of a reduced righting moment on vessel 11 produced by the system of the present invention. Curve 37 shows the ratio of roll amplitude to wave slope for a vessel which is not stabilized; whereas curve 39 illustrates the roll amplitude characteristic for vessel 11 stabilized according to the principles of the invention. The unstabilized vessel has a roll amplitude characteristic with a resonant peak at seven seconds. Wave motion in an open sea also typically has a seven second period. Thus, without stabilization the vessel will have a roll amplitude which is at or near the maximum point P of its resonant peak. In contrast, the stabilized vessel 11 has a resonant peak which occurs at about a twelve second period, which is substantially longer than the typical seven second wave period in an open sea. Thus, for seven second waves, the stabilized vessel will operate at point S on curve 39, and the roll amplitude will be reduced to less than one-sixth of what it was in the unstabilized vessel.

Vessel 11 is a barge about 375 feet long. Each of the tanks 15, 17 is about 275 feet long and divided into six compartments of equal size. The width of each tank is 10 to 12 feet and its height is 6 to 7 feet. The conduits 23 which connect the compartments of the tanks are each about 3 to 4 feet in diameter.

Although vessel 11 is shown as a barge, it is to be understood that other types of vessels may be stabilized utilizing the principles of the present invention. For example, the stabilization system may be applied to triangular of rectangular shaped jack-up oil drilling rigs. The tanks may be symmetrically disposed with respect to the geometric center of the vessel, e.g., at the vertices of a triangular shaped rig or at the corners of a rectangular rig. In order to stabilize against both roll and pitch, all tanks may be coupled in common through conduits to a source of air pressure. With this arrangement both roll and pitch righting moments are reduced.

I claim:

1. A passive system for stabilizing a seagoing vessel having an axis of symmetry comprising:

a plurality of tanks disposed on said vessel in spaced-apart pairs on opposite sides of said axis and below the water line, each of said tanks having a bottom portion substantially completely open to the sea; and being dimensioned to fill and drain in phase with oscillatory vessel motion relative to the surface of the sea during each cycle of said oscillatory motion;

conduit means coupled to the top surfaces of said tanks for providing separate passive air passageways between each of said pairs of tanks, and said conduit means including a continuous open pipe interconnecting each of said pairs of tanks;

means coupled to said conduit means for providing a selected air pressure in said tanks and said conduit means to permit selected water levels to be attained in said tanks during oscillatory motion of said vessel, thereby to reduce the righting moment of said vessel and lengthen the period of oscillation of said vessel beyond the wave period of the sea.

2. The system of claim 1 wherein said tanks are disposed on the bottom of said vessel.

3. The system of claim 1 wherein the tank height dimension of each of said tanks is selected to permit complete filling and draining of each tank during a portion of a cycle of oscillatory motion of the vessel, thereby to prevent capsizing of the vessel by causing the righting moment thereof to increase rapidly as a function of additional angular displacement of the vessel during the portion of the cycle that one of said tanks is completely filled.

4. The system of claim 1 wherein said means for providing air pressure in said tanks is adjustable to permit water to completely fill the tanks on one side of said axis during a portion of a cycle of the oscillatory motion of said vessel.

5. The system of claim 1 wherein said means for providing air pressure in said tanks includes an air pump and valve means for isolating said air pump from said conduit means.

* * * * *